US005334967A

United States Patent [19]

Paszkiewicz

[11] Patent Number: 5,334,967

[45] Date of Patent: Aug. 2, 1994

[54] VOLTAGE DIVIDER

[75] Inventor: George Paszkiewicz, Hinsdale, Ill.

[73] Assignee: Illinois Tool Works Inc., Glenview, Ill.

[21] Appl. No.: 84,889

[22] Filed: Jun. 29, 1993

[51] Int. Cl.[5] ..... H01C 10/06

[52] U.S. Cl. ..... 338/95; 338/96; 338/97; 338/99; 338/323

[58] Field of Search ..... 338/92, 95, 323, 114, 338/99, 96, 97

[56] References Cited

U.S. PATENT DOCUMENTS

| | | | |
|---|---|---|---|
| 3,102,989 | 9/1963 | Sielsch | 338/154 |
| 3,377,604 | 4/1968 | Forrest | 338/154 |
| 3,440,522 | 4/1969 | Kruse | 323/63 |
| 3,624,583 | 11/1971 | Nakada | 338/69 |
| 3,764,953 | 10/1973 | Lehnert | 338/154 |
| 3,895,288 | 7/1975 | Lampen et al. | 338/119 X |
| 3,968,467 | 7/1976 | Lampen et al. | 338/119 |
| 4,274,074 | 6/1981 | Sakamoto | 338/160 |
| 4,333,068 | 6/1982 | Kishel | 338/158 |
| 4,444,998 | 4/1984 | House | 178/19 |
| 4,494,105 | 1/1985 | House | 338/114 |
| 4,573,106 | 2/1986 | Kuratani | 362/28 |
| 4,651,123 | 3/1987 | Zepp | 338/176 |
| 4,817,419 | 4/1989 | Iden | 73/118.1 |
| 4,978,939 | 12/1990 | Zeitovogel | 338/176 |

*Primary Examiner*—Marvin M. Lateef
*Attorney, Agent, or Firm*—T. W. Buckman; J. P. O'Brien

[57] ABSTRACT

A voltage divider which can be manipulated so as to vary the output voltage thereof, prevents mechanical wear of the voltage divider element, provides continuous contact, and can be sealed so as to prevent interaction with the ambient atmosphere including first and second non-conductive substrates with a predetermined spaced portion therebetween. A first conductive strip on the second substrate is depressed across the spaced portion so as to contact at least one of a plurality of conductive taps on the first substrate, each of which are in contact with a voltage divider element so as to complete a desired circuit. By sliding while depressing the second substrate along its surface where the conductive strip is positioned, one or more successive taps are contacted so as to vary the voltage supplied to the circuit.

20 Claims, 2 Drawing Sheets

VOLTAGE DIVIDER

BACKGROUND OF THE INVENTION

Field of the Invention

The present invention relates generally to voltage dividers or potentiometers, and more particularly to a voltage divider which prevents mechanical wear of the voltage divider element, provides continuous contact during use and can be sealed to prevent exposure with ambient atmosphere.

Description of the Related Art

Voltage dividers or potentiometers typically include a contact element which can be moved along the length of a voltage divider or resistive element so as to vary the resistance and voltage of a circuit to which the device is connected.

An example of such a device is illustrated in U.S. Pat. No. 4,651,123 which discloses a linear potentiometer of a sandwich type construction including a pair of conductive strips, one each on a pair of non-conductive flexible substrates with a slotted spacer secured therebetween. A spring loaded ball assembly causes contact to be developed between the conductive strips through means of the slot and can be moved to various points along the length of the strips so as to vary the resistance.

Such a potentiometer, however, relies on direct mechanical contact between the conductive strips or resistive elements. Such contact eventually leads to wear of the strips which in turn changes the electrical characteristics of the device.

To reduce such wear of the voltage divider or resistive element, contact can be made with a series of conductive taps which in turn are in contact with the voltage divider or resistive element. An example of such a device is illustrated in U.S. Pat. No. 4,274,074.

That patent, however, relies on dual contact elements to insure a continuous voltage and direct mechanical contact with the conductive taps which eventually can lead to a change in the characteristics of the device. Furthermore, such a device is not sealed from the ambient atmosphere.

It therefore would be desirable to provide a voltage divider which prevents mechanical wear of the voltage divider element as well as the taps, provides continuous contact during use, can be sealed from the ambient atmosphere and where the taps can be positioned in a variety of patterns to so as accommodate a specific application.

SUMMARY OF THE INVENTION

The invention provides a voltage divider having first and second non-conductive substrates with a predetermined spaced portion between the substrates. A first conductive strip on a portion of the second substrate is depressed across the spaced portion so as to contact at least one of a plurality of conductive taps on the first substrate which are in contact with a voltage divider element and completes a desired circuit. By sliding while depressing downwardly on the second substrate anywhere along its surface where the conductive strip is positioned, one or more successive taps are contacted so as to vary the voltage supplied to the circuit.

BRIEF DESCRIPTION OF THE DRAWINGS

Various objects, features, and attendant advantages of the present invention will become more fully appreciated from the following detailed description, when considered in connection with the accompanying drawings, in which like reference characters designate like or corresponding parts throughout the several views, and wherein.

DESCRIPTION OF THE PREFERRED EMBODIMENTS

Figure 1:
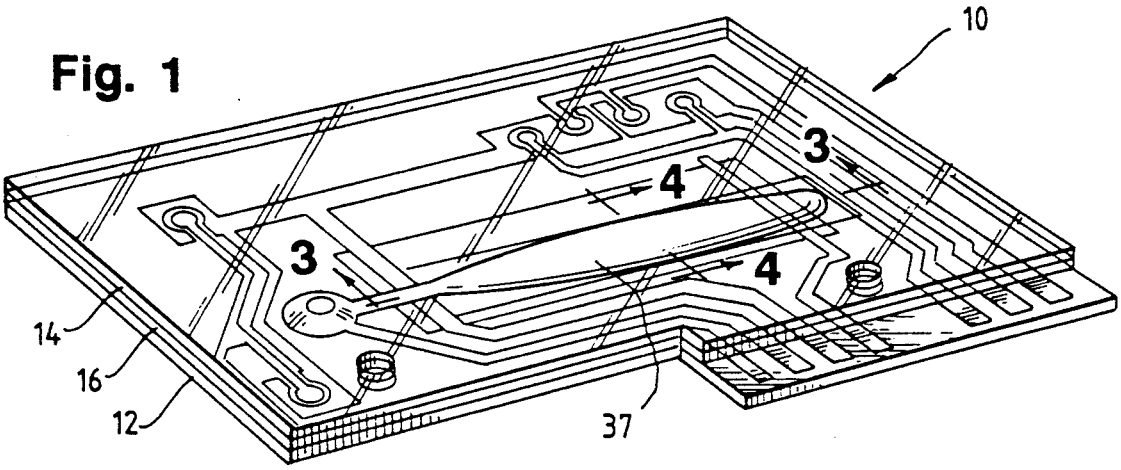
FIG. 1 is a perspective view of the device of the invention positioned within a desired circuit.
Figure 2:
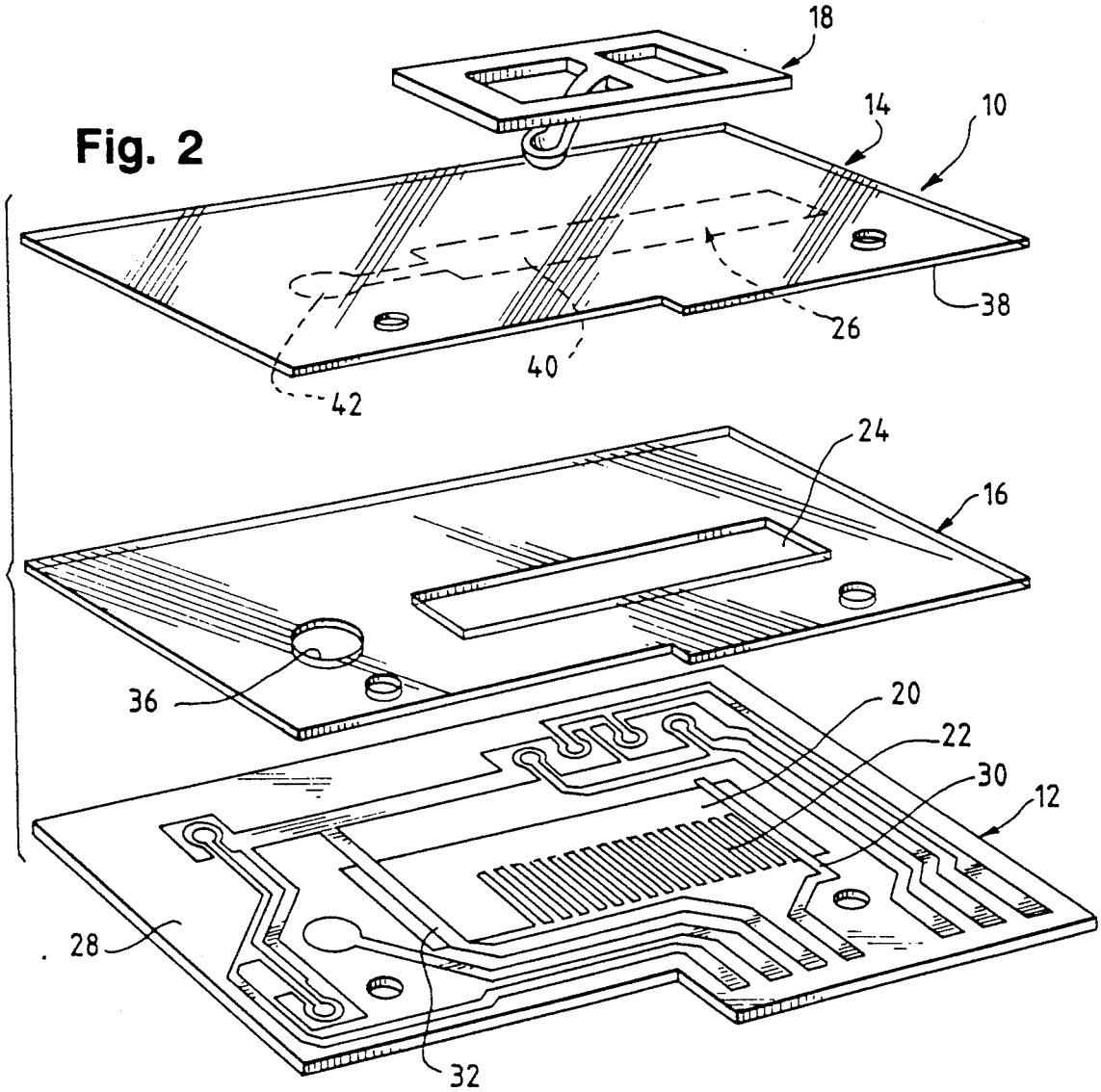
FIG. 2 is an exploded view of the device of the invention including an actuator element.

Referring to FIGS. 1 and 2, the voltage divider device of the invention is designated generally by the reference numeral 10. The device 10 is preferably assembled so as to form a completely sealed sandwich type assembly, but such can vary.

The device 10 substantially includes a first substrate 12, a second substrate 14 and a spacer member 16. In order to vary the resistance and voltage of the device 10, an actuator element 18, illustrated in FIG. 2, is utilized as described below.

Figure 3:
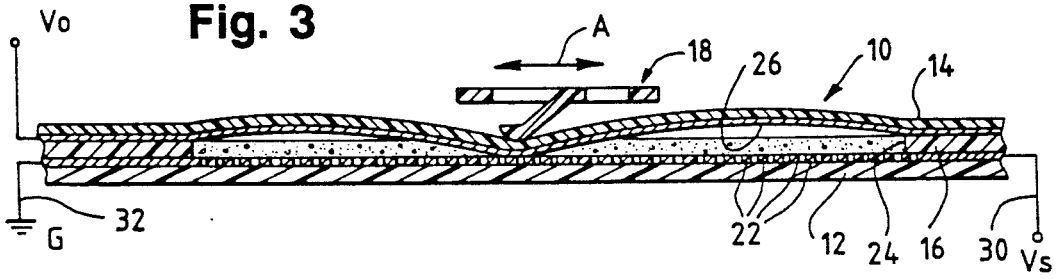
FIG. 3 is a longitudinal cross-sectional view taken along line 3—3 of FIG. 1 in the direction indicated generally and schematically illustrating the electrical connections of the device.
Figure 4:
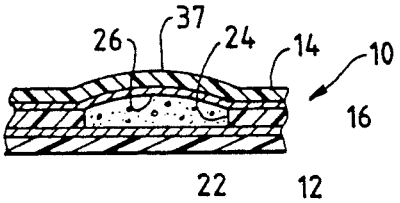
FIG. 4 is a partial cross-sectional view taken along line 4—4 of FIG. 1 in the direction indicated generally.

Briefly, in operation, the first substrate 12 includes a voltage divider or resistive element 20 and a plurality of conductive taps or pads 22 arranged in succession along a portion thereof and in contact with predetermined portions of the resistive element 20. The spacer 16 includes a slot 24 which is aligned over the taps 22. The second substrate 14 includes a conductive strip 26 on one side thereof for contact with the taps 22, through means of the slot 24, upon being depressed by the actuator element 18 as illustrated in FIG. 3. Moving the actuator element 18 in either direction along the line "A" provides electrical contact between the conductive strip 26 and one or more taps 22 so as to in turn vary the resistance and voltage output of the device 10.

Details of the structure of the device 10 will now be provided.

The first substrate 12 is preferably is a rigid member made from conventional printed circuit board material such as CEM-1, FR4, Mylar, Cermet or the like to a thickness of 5 mils or more. The substrate 12, however, can be made from any material in any thickness and can be flexible so long as the device 10 functions as described herein.

As FIG. 2 illustrates, a top surface 28 of the first substrate 12 includes the desired circuit thereon, which is preferably provided by means of a conductive foil formed from copper, silver or any similar material. It is to be understood that the particular circuit and material utilized to form the circuit can vary.

The voltage divider or resistive element 20 is also provided on the top surface 28 of the first substrate and is preferably is rectangular in shape with a predetermined length. As FIGS. 2 and 3 illustrate, the resistive element 20 is preferably is connected at one end to a voltage supply lead 30 and at an opposite end to a ground lead 32, but such construction can vary.

It is to be understood that the particular configuration of the device 10 including the layout of the resistive element 20 and taps 22 can vary so long as they function as described herein. Accordingly, it is conceivable that the resistive element 20 and taps 22 can be laid out in a circle or any other shape.

The resistive element 20 is preferably is made from a PTF ink (polymer thick film ink), a cermet film (ceramic metallic film), a carbon film or any other type of material so long as it functions as desired. The resistance provided by the resistive element 20 depends upon the thickness and material utilized. Preferably, the material comprising the resistance element 20 is silk-screened onto the top surface 28 of the first substrate 12.

In order to maintain the electrical characteristics of the resistive element 20 substantially constant during the life of the device 10, variable contact is made with the taps 22, not with the resistive element 20 itself. The taps 22 can be made from any type of conductive material and are preferably are shaped so that a portion of each tap 22 is individually connected to desired positions on the resistive element 20.

Preferably, in order to provide for ease of manufacture, the taps 22 can be silk-screened on the top surface 28 of the first substrate 12 with the same material utilized to form the resistive element 20. Although the resistive characteristics of the device 10 will be modified slightly if the taps 22 and resistive element 20 are made of the same material, the change is of little concern due to the high impedance of the device 10. Thus, it is not necessary that the taps 22 be formed with a low resistance material, which greatly simplifies production of the device 10.

Figure 5:
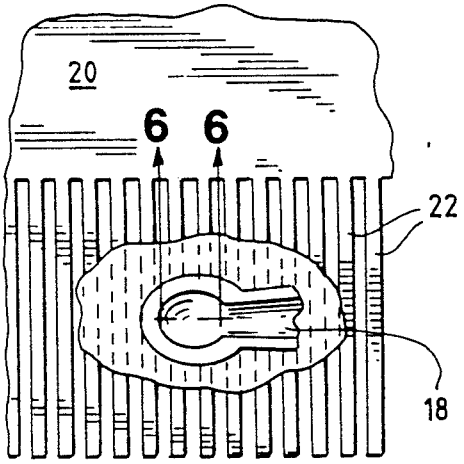
FIG. 5 is a partial top plan view of an embodiment of the voltage divider element, taps and actuator element of the invention.
Figure 7:
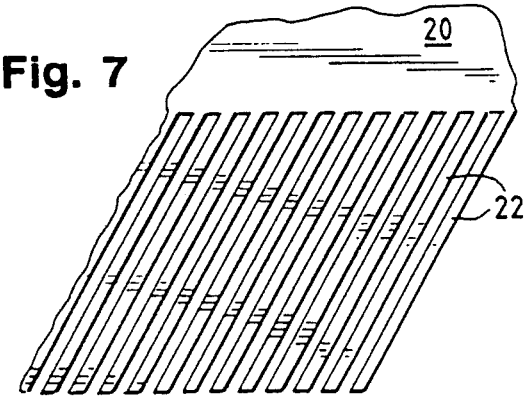
FIG. 7 is a partial top plan view of another embodiment of the voltage divider element and taps of the invention.

As FIGS. 2 and 5 illustrate, the taps 22 preferably are formed as elongate parallel rods in a "comb" like configuration where the taps 22 extend perpendicularly away from the resistive element 20 with a predetermined substantially equal space between consecutive taps 22. Alternatively, as FIG. 7 illustrates, the taps 22 can be positioned at an angle with respect to the resistive element 20 or in any other configuration.

Figure 8:
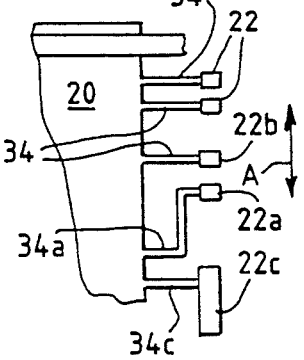
FIG. 8 is a partial top plan view of another embodiment of the voltage divider element and taps of the invention.

Additionally, as FIG. 8 illustrates, the taps 22 can be formed as square or rectangular tabs which can be positioned at an equal distance from each other or with a substantial gap between successive taps 22 for reasons described hereinafter. A lead or "tap conduct" 34 connects each tap 22 to a respective portion of the resistive element 20. The leads 34 can be formed from the same material as the resistive element 20 and taps 22 so as to further simplify production and reduce costs.

In any event, contact with a different tap 22 provides a shorter or longer path across the resistive element 20 which decreases or increases the resistance, respectively, and provides the desired change in output voltage of the device 10. Such a device 10 is desirable, for example, in order to provide variable speed to an electric motor or some other apparatus.

The number of taps 22 and their connection with the resistive element 20 can vary. For example, if ten taps 22 are positioned at equal intervals along the length of the resistive element 20 with a supply voltage of ten volts, each tap 22 will substantially provide voltage changes in increments of one volt each.

Alternatively, if more or less taps 22 are utilized with the same ten volts of supply voltage, the increments will be smaller or larger, respectively, so as to provide a stepped voltage output which becomes substantially linear as the number of taps 22 increases. Similarly, if the taps 22 or leads 34 are staggered, as illustrated in FIG. 8, voltage jumps or discontinuous output voltage can be provided which is desirable in many applications.

FIG. 8 also illustrates a design of the resistive element 20 and taps 22 which provides a large change in voltage with a small movement of the actuator element 18. Specifically, tap **22*a* is positioned adjacent tap 22*b* with a short linear travel distance defined therebetween for the actuator element 18. The lead 34*a*, however, connects to a position on the resistive element 20 which is remote from the tap 22*a*** defined to provide a larger change in voltage.

Additionally, tap **22*c* can be rectangular with a single lead 34*c*. This enables travel of the actuator element 18 along the length of the tap 22*c* with no change in output voltage which is also desirable in some applications. In short, the size shape and position of the taps 22 and leads 34** can vary to provide a variety of voltage outputs, both linear and non-linear as well as combinations thereof.

The spacer 16 is preferably secured to the top surface 28, such as by an adhesive, heat bonding or other method, with the slot 24 positioned only over the taps 22. The spacer 16 is preferably non-conductive, can be flexible or rigid and can be formed from a variety of materials, such as Mylar or the like.

The spacer 16 has a predetermined thickness selected so as to prevent contact of the conductive strip 26 with the taps 22 unless depressed by the actuator element 18. Accordingly, the thickness of the spacer 16 is preferably between 1–2 mils thick, but can vary depending on the particular application. In order to enable contact of the conductive strip 26 with the remainder of the circuit, the spacer 16 also includes an aperture 36 therethrough.

The second substrate 14 is preferably flexible, approximately 5 mils thick and is formed from any desired non-conductive material, such as Mylar or the like. As with the spacer 16, the second substrate 14 can be heat bonded, adhesively secured or otherwise attached to the first substrate 12 so long as a seal is provided therebetween.

As FIG. 1 illustrates, in order to assist in preventing unwanted contact between the conductive strip 26 and the resistive element 20, the second substrate 14 can include a domed or "bubble" portion 37. The bubble portion 37 can be formed before the first and second substrates 12 and 4 are connected, such as by a gas, or can be formed directly into the second substrate 14 in a preceding operation, such as by thermoforming. The gas is preferably air dried to a predetermined amount or any other type of gas.

It is to be noted that the bubble portion 37 can be utilized with or without a spacer 16. Thus, a simple device 10 can be provided by the present invention without a spacer 16 but including the bubble portion 37 which is sealed about its periphery to the first substrate 12 to prevent the gas from leaking to other areas of the device 10 or to the ambient atmosphere.

Additionally, the adhesive which secures the first and second substrates 12 and 14 can be selected to form the desired spacing therebetween with a relieved area for contact between the conductive strip 26 and the taps 22 (not illustrated.) In such a situation, the spacer 16 would not be needed and the bubble portion 37 would be optional.

The conductive strip 26 is formed on a bottom surface 38 of the second substrate 14 and has an elongate rectangular portion 40 and a circular head portion 42. The rectangular portion 40 substantially corresponds to the shape of the slot 24 of spacer 16 and the area occupied by the taps 22 while the head portion 42 corresponds to the shape of the aperture 36 in the spacer 16.

The actuator element 18 can be of any configuration so long as an engagement portion 44 is provided so as to establish contact between the conductive strip 26 and the taps 22 as illustrated in FIG. 3. Typically, the actuator element 18 is in the form of a slider or rotary switch which is manipulated by a user so as to change the electrical output of an apparatus to which it is connected. If desired, a housing or other mounting structure (not illustrated) can be utilized with the device 10 to enclose the device 10 and mount the actuator 18 in position with respect to the device 10. Additionally, a spring loaded ball structure (not illustrated) can be utilized with the actuator element 18.

In use, as FIG. 3 illustrates, a supply voltage Vs is supplied to the resistive element 20 by means of the lead 30. An output voltage Vo is supplied to the conductive strip 26 through contact of the strip 26 with the taps 22 by the pressure supplied by the actuator element 18.

To change the output voltage Vo, the actuator element 18 is moved in either direction along the line "A" so as to contact successive taps 22 which increases or decreases the path along the length of the resistive element 20 to in turn vary the resistance and output voltage.

Figure 6:
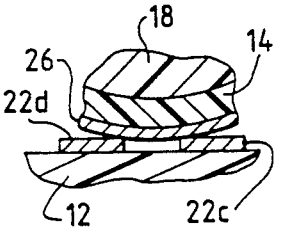
FIG. 6 is a partial cross-sectional view taken along line 6—6 of FIG. 5 illustrating the continuous contact provided by the actuator element and successive taps.

As FIG. 6 illustrates, when the taps 22 are positioned substantially close together, the actuator element 18 is large enough to provide contact of the strip 26 with a subsequent tap **22*d* before contact with a previous tap 22*e*** is broken. This "make-before-break" feature enables continuous voltage to be supplied.

Alternatively, as FIG. 8 illustrates, tap **22*b* can be positioned at a greater distance from an adjacent tap 22. Thus, as the actuator element 18** moves between those two taps, the output voltage would be discontinuous which may be desired.

Similarly, as the actuator element 18 moves between taps **22*b* and 22*a*, a somewhat larger change in output voltage will occur. Such a change, however, is gradual due to the design of the device 10 and its circuit. Thus, the output voltage can be increased, for example, by fifty percent without having to move the actuator element 18 fifty percent of the distance along the first substrate 12 and resistive element 20**.

The tap **22*c* enables a more gradual voltage increase along the length of travel on the strip 26 by providing the same output voltage upon travelling a substantial distance by the actuator element 18**.

Modifications and variations of the present invention are possible in light of the above teachings. It therefore is to be understood that within the scope of the appended claims the invention may be practiced other than as specifically described.

What is claimed and desired to be secured by letters patent is:

1. A voltage divider, comprising:

a first non-conductive substrate having first and second opposite surfaces;

a second non-conductive flexible substrate having first and second opposite surfaces, said first surface of said second substrate facing, and being sealed to, said first surface of said first substrate;

non-conductive spacing means, having a slot defined therein, interposed between said first and second substrates for positioning at least a predetermined portion of said second substrate at a distance from said first substrate;

a longitudinally extending conductive strip, electrically connected to a desired circuit, disposed upon a portion of said first surface of said second substrate which corresponds to said predetermined portion of said second substrate which is spaced from said first substrate;

longitudinally extending voltage divider resistance means disposed upon a first portion of said first surface of said first substrate which is remote from said predetermined spaced portion of said second substrate upon which said longitudinally extending conductive strip is disposed; and a plurality of conductive taps disposed upon a second portion of said first surface of said first substrate and extending laterally from said longitudinally extending voltage divider resistance means so as to be disposed in a longitudinally extending array with a predetermined distance being defined between successive ones of said plurality of conductive taps, said plurality of conductive taps being integrally connected to said longitudinally extending voltage divider resistance means and being positioned substantially beneath said predetermined spaced portion of said second substrate upon which said longitudinally extending conductive strip is disposed such that a user can depress said predetermined spaced portion of said second substrate so as to establish electrical contact between a predetermined portion of said longitudinally extending conductive strip and at least one of said plurality of conductive taps, by causing said predetermined portion of said longitudinally extending conductive strip to be moved through said slot of said non-conductive spacing means, so as to complete said circuit and provide a desired voltage thereto whereby said user can selectively depress said predetermined spaced portion of said second substrate anywhere along its length where said longitudinally extending conductive strip is correspondingly positioned so as to provide selective contact of a predetermined portion of said longitudinally extending conductive strip with one or more of said successive ones of said plurality of conductive taps and thereby vary said voltage supplied to said circuit.

2. The voltage divider as defined in claim 1 wherein said first and second substrates and said spacing means are sealed together so as to prevent contact of said conductive strip, said voltage divider means and said taps by another member and ambient atmosphere.

3. A voltage divider as set forth in claim 1, wherein: said longitudinally extending array of said plurality of conductive taps comprises a substantially linear array of said plurality of conductive taps.

4. The voltage divider as defined in claim 2 wherein said bubble portion is pre-formed in said second substrate before connecting said second substrate to said first substrate.

5. The voltage divider as defined in claim 4 wherein said bubble portion is preformed by a gas captured between said first and second substrates.

6. The voltage divider as defined in claim 4 wherein said bubble portion is preformed by forming a portion of said second substrate so as to include said bubble portion prior to connecting said first and second substrates together.

7. The voltage divider as defined in claim 1 wherein said voltage divider resistance means includes a resistive element connected to both a voltage supply and ground.

8. The voltage divider as defined in claim 7 wherein each of said taps are connected to a predetermined portion of said resistive element so as to vary the voltage between taps.

9. The voltage divider as defined in claim 8 wherein each of said taps includes a first contact pad portion of a predetermined size and shape and a separate lead electrically connecting a respective contact pad to a predetermined portion of said resistive element.

10. The voltage divider as defined in claim 9 wherein said leads are arranged substantially parallel to each other.

11. The voltage divider as defined in claim 10 wherein said parallel leads are positioned at a predetermined angle with respect to said resistive element.

12. The voltage divider as defined in claim 9 wherein said leads are connected so as to provide a substantially different voltage to said circuit between successive taps.

13. The voltage divider as defined in claim 1 wherein said taps are positioned substantially along an axis and are separated from each other a predetermined distance, said distance substantially being the same.

14. The voltage divider as defined in claim 1 wherein said taps are positioned substantially along an axis and are separated from each other a predetermined distance, said distance being variable.

15. The voltage divider as defined in claim 1 including an actuator element in operative communication with said second surface of said second substrate, said actuator element including an engagement portion thereon for movement along said second surface of said second substrate and for depressing said conductive strip of said second substrate through said slot of said spacing so as to contact said conductive strip with one or more taps of said first substrate, said engagement portion being dimensioned with respect to said taps so that upon movement of said engagement portion the contact of said conductive strip with a respective tap is not broken before said conductive strip makes contact with a subsequent tap.

16. The voltage divider as defined in claim 1 wherein said voltage supplied between taps is non-linear.

17. The voltage divider as defined in claim 1 wherein said first and second substrates are connected by an adhesive.

18. The voltage divider as defined in claim 17 wherein said adhesive is provided with a predetermined thickness in selected areas between said first and second substrates so as to provide said spacing means.

19. A voltage divider, comprising:

a first non-conductive substrate having first and second opposite surfaces;

a second non-conductive flexible substrate having first and second opposite surfaces, said first surface of said second substrate facing, and being sealed to, said first surface of said first substrate;

spacing means, including a bubble portion provided within said second substrate, for positioning at least a predetermined portion of said second substrate at a distance from said first substrate;

a conductive strip, electrically connected to a desired circuit, disposed upon a portion of said first surface of said second substrate which corresponds to said predetermined portion of said second substrate which is spaced from said first substrate;

voltage divider means disposed upon a first portion of said first surface of said first substrate which is remote from said predetermined spaced portion of said second substrate upon which said conductive strip is disposed; and a plurality of conductive taps disposed upon a second portion of said first surface of said first substrate which is positioned substantially beneath said predetermined spaced portion of said second substrate upon which said conductive strip is disposed such that a user can depress said predetermined spaced portion of said second substrate so as to establish electrical contact between a predetermined portion of said conductive strip and at least one of said plurality of conductive taps so as to complete said circuit and provide a desired voltage thereto whereby said user can selectively depress said predetermined spaced portion of said second substrate anywhere along its length where said conductive strip is correspondingly positioned so as to provide selective contact of a predetermined portion of said conductive strip with one or more of said successive ones of said plurality of conductive taps and thereby vary said voltage supplied to said circuit.

20. A voltage divider as set forth in claim 19, wherein:

said spacing means further comprises a non-conductive spacer, having a slot defined therein, interposed between said first and second substrates.

* * * * *